US011850614B2

(12) United States Patent
Marcon

(10) Patent No.: US 11,850,614 B2
(45) Date of Patent: Dec. 26, 2023

(54) COLOUR CHANGE SYSTEM FOR POWDER COATING

(71) Applicant: CARLISLE FLUID TECHNOLOGIES, INC., Scottsdale, AZ (US)

(72) Inventor: Henry Marcon, Scottsdale, AZ (US)

(73) Assignee: Carlisle Fluid Technologies, LLC, Scottsdale, AZ (US)

( * ) Notice: Subject to any disclaimer, the term of this patent is extended or adjusted under 35 U.S.C. 154(b) by 633 days.

(21) Appl. No.: 16/646,915

(22) PCT Filed: Sep. 11, 2018

(86) PCT No.: PCT/IB2018/056927

§ 371 (c)(1),
(2) Date: Mar. 12, 2020

(87) PCT Pub. No.: WO2019/053590

PCT Pub. Date: Mar. 21, 2019

(65) Prior Publication Data

US 2020/0276604 A1 Sep. 3, 2020

(30) Foreign Application Priority Data

Sep. 12, 2017 (GB) ..... 1714651

(51) Int. Cl.
*B05B 12/14* (2006.01)
*B05B 15/50* (2018.01)
(Continued)

(52) U.S. Cl.
CPC ..... *B05B 12/149* (2013.01); *B05B 7/1472* (2013.01); *B05B 15/50* (2018.02); *B05D 1/12* (2013.01)

(58) Field of Classification Search
USPC ..... 118/308, 309, 302; 55/DIG. 46; 454/53; 134/167 C; 427/180
See application file for complete search history.

(56) References Cited

U.S. PATENT DOCUMENTS 5,765,971 A 6/1998 Rutz
5,928,423 A 7/1999 Toyota et al.
(Continued)

FOREIGN PATENT DOCUMENTS

CN 103476510 A 12/2013
EP 0629451 A1 12/1994
(Continued)

OTHER PUBLICATIONS

PCT International Search Report for PCT Application No. PCT/IB2018/056927 dated Dec. 19, 2018, 6 pgs.
(Continued)

*Primary Examiner* — Yewebdar T Tadesse
(74) *Attorney, Agent, or Firm* — Fletcher Yoder, P.C.

(57) ABSTRACT

A colour change system for a powder coating facility comprises a plurality of containers 24*a*-24*e* each with a different colour powders; a conduit for conveying powder from one of the containers 24*a*-24*e* to a coating applicator 12; a suction unit 18 connected to the conduit and having an end-piece with a powder-drawing inlet opening; a cleaning unit 34; a translation mechanism for moving the end-piece; and a controller. The containers 24*a*-24*e* and the cleaning unit 34 each have an opening 25 for receiving the end piece. The controller effects a change of powder colour by controlling the translation mechanism to extract the end-piece from a first container 24*d*, to move it to the cleaning unit 34, and after cleaning to move the end piece to a second container 24*e*. The system allows automated cleaning between colour changes, which reduces operating downtime.

13 Claims, 5 Drawing Sheets

(51) Int. Cl.
*B05B 7/14* (2006.01)
*B05D 1/12* (2006.01)

(56) References Cited

U.S. PATENT DOCUMENTS

| | | | | |
|---|---|---|---|---|
| 6,699,325 | B2 * | 3/2004 | Mauchle | B05B 7/1472 118/308 |
| 7,074,274 | B1 * | 7/2006 | Shutic | B05B 7/1454 118/309 |
| 2017/0136486 | A1 * | 5/2017 | Woolery | B31B 50/624 |
| 2017/0159163 | A1 | 6/2017 | Nettesheim | |

FOREIGN PATENT DOCUMENTS

| | | | |
|---|---|---|---|
| EP | 1222963 | A2 | 7/2002 |
| JP | H0663464 | A | 3/1994 |
| WO | 0115813 | A2 | 3/2001 |
| WO | 2009123794 | A1 | 10/2009 |

OTHER PUBLICATIONS

Chinese Office Action for CN Application No. 201880072064.9, dated Mar. 10, 2021, 9 pgs.
Zuming Han, et al., "Automotive Coating Technology," Tianjin Science and Technology Press, Jun. 30, 2014, pp. 130-132.
Chinese Office Action for CN Application No. 201880072064.9, dated Sep. 2, 2022, 9 pgs.

* cited by examiner

COLOUR CHANGE SYSTEM FOR POWDER COATING

CROSS-REFERENCE TO RELATED APPLICATIONS

This application is a National Stage Application of PCT International Application No. PCT/IB2018/056927 entitled "COLOUR CHANGE SYSTEM FOR POWDER COATING," filed on Sep. 11, 2018, which is herein incorporated by reference in its entirety, and which claims priority to Great Britain Patent Application No. 1714651.5, entitled "COLOUR CHANGE SYSTEM FOR POWDER COATING," filed on Sep. 12, 2017, which is herein incorporated by reference in its entirety.

FIELD OF THE INVENTION

The present invention relates to a colour change system for powder coating. More particularly the invention concerns a system for automatic change of a powder coating colour suitable for use with a hand operated or a robot-operated coating applicator.

BACKGROUND

Powder coating is used extensively for coating components, often metal components, in a wide range of industries such as vehicle manufacturing. A coloured powder is supplied through a suitable conduit from a powder reservoir to an applicator, such as a spray gun. Powder coating is increasingly being carried out in automated production facilities, for example using robotically controlled applicators. When different colours of coating are required, it has traditionally been necessary to use multiple different applicators, one for each different colour, because to change colour using the same applicator and conduit requires a time consuming cleaning operation. Having multiple different applicators and conduits for a robotically operated process adds significantly to the complexity and cost of the coating installation.

U.S. Pat. No. 5,928,423 discloses a color-changing powder system for use in powder coating. The powder supply comprises a powder tank and a powder supply apparatus detachably connected to the power tank.

The present invention has been conceived in light of the above.

SUMMARY

In a first aspect the invention provides a colour change system for a powder coating facility, comprising: a plurality of powder containers, each container holding one of a plurality of different coloured coating powders; a conduit for conveying powder from one of the powder containers to a coating applicator; a suction unit connected to the conduit and having an end-piece with an inlet opening into which coating powder is drawn; a cleaning unit; a translation mechanism for moving the end-piece of the conduit; and a controller. Each of the plurality of powder containers has one or more openings in an upper surface into which the end piece of the suction unit can be inserted. The cleaning unit has an opening for receiving the end piece of the suction unit. The controller is configured to effect a change of powder colour by controlling the translation mechanism to extract the end-piece of the conduit from a first powder container, to move the end piece of the conduit to the cleaning unit, and after cleaning to move the end piece to a second, different powder container and insert the end piece into the second container.

It is an advantage that the translation mechanism allows for an automated movement and cleaning of the powder spray delivery equipment between changes of colour, which provides a significant reduction in plant operating downtime.

The translational mechanism may comprise mechanisms providing a vertical, or y-direction translation of the end piece, a first horizontal, or x-direction translation of the end-piece. The y-direction and x-direction movements may be independently controllable by the controller. The translational mechanism may comprise a third, or second horizontal, or z-direction, of movement of the end-piece, wherein the third direction movement moves the end-piece out of alignment with the openings in the upper surfaces of the powder containers. Each of the y-direction, x-direction and z-direction movements may be independently controllable by the controller. The translation mechanism may comprise at least one pneumatically operated cylinder.

The cleaning mechanism may comprise a vertically oriented chamber for receiving the end piece of the suction unit through a top opening, a first air blowing arrangement for cleaning an outer surface of the conduit and a second air blowing arrangement for cleaning the insides of the suction unit and conduit. The first air blowing arrangement may comprise one or more nozzles through which air is blown into the chamber and over the outer surfaces of the suction unit, and an air outlet for removing air and powder removed off the outer surface of the conduit. The one or more nozzles may be located adjacent the top opening and the air outlet is located adjacent a bottom of the chamber. The second air blowing arrangement may comprise an air inlet for blowing air into the inlet opening of the suction unit. The second air blowing arrangement may be sufficiently strong to blow air through to the paint applicators (guns). This allows the paint passages of the paint applicators to be cleaned. The second air blowing arrangement may comprise a spring valve that is configured to be activated by contact from the end piece of the suction unit to open and permit air to be blown into the inlet of the suction unit. A means for providing suction may be connected to the air outlet.

The suction unit may comprise an inducer in the end piece adjacent to the inlet opening of the suction unit. The inducer may comprise an air nozzle and a venturi tube section. The inducer may be located at one end of a tube that connects to the conduit and the suction unit further comprises a passage for compressed air to be provided to the inducer nozzle. The inlet of the suction unit may comprise a plurality of inlet channels leading from an exterior of the end piece to the inducer. The suction unit may further comprise an air duct for providing air to fluidise powder in the vicinity of the inlet opening.

In a second aspect, the invention provides a method of changing colour in a powder coating facility. The method comprises providing a colour changing apparatus comprising: a plurality of powder containers, each container holding one of a plurality of different coloured coating powders; a conduit for conveying powder from one of the powder containers to a coating applicator; a suction unit connected to the conduit and having an end-piece with an inlet opening into which coating powder is drawn; a cleaning unit; and a translation mechanism for moving the end-piece of the conduit. The method further comprises: extracting the end-piece of the suction unit from a first powder container; moving the suction unit to the cleaning unit; cleaning the suction unit and the conduit; after cleaning moving the suction unit to a second, different powder container, and inserting the end piece of the suction unit into the second container.

In a third aspect, the invention provides a colour change system for a powder coating facility. The system comprises: a plurality of powder containers, each container holding one of a plurality of different coloured coating powders; a conduit for conveying powder from one of the powder containers to a coating applicator; a suction unit connected to the conduit and having an end-piece with an inlet opening into which coating powder is drawn; and a translation mechanism configured to move the end-piece of the conduit from one container to another container. The suction unit comprises an inducer in the end piece adjacent to the inlet opening of the suction unit.

DETAILED DESCRIPTION

Figure 1:
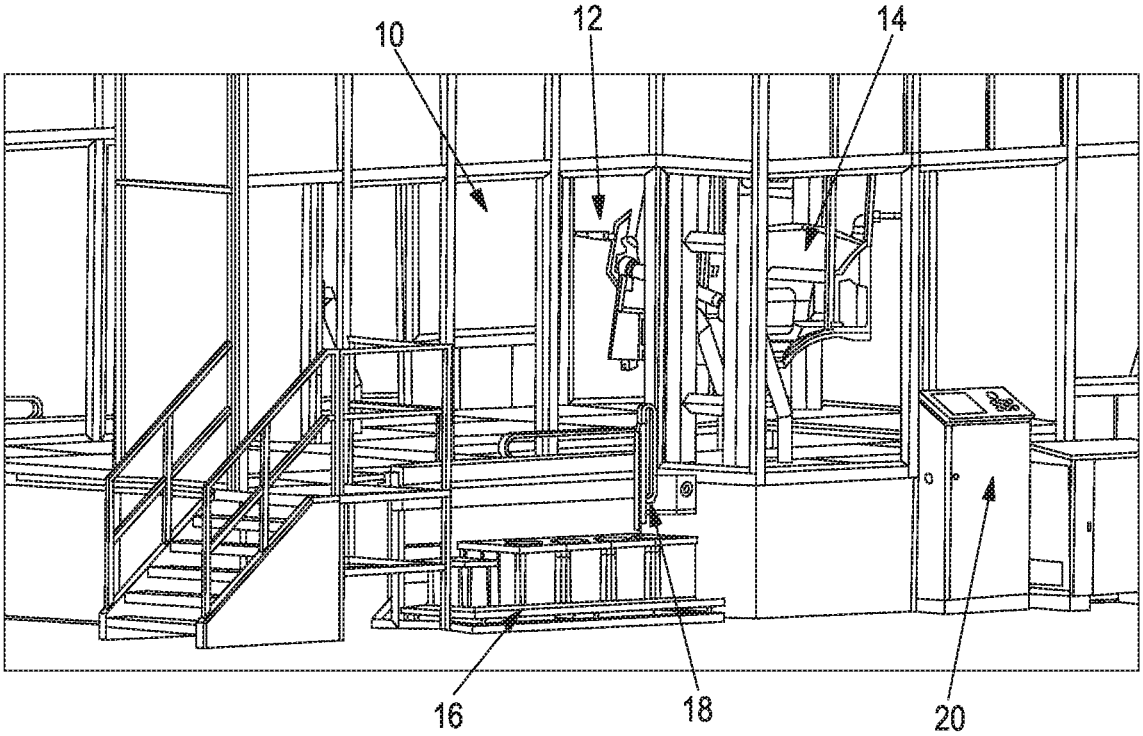
FIG. 1 is an illustration of a powder coating facility employing a colour change system in accordance with embodiments of the invention.

Referring to FIG. 1, there is shown a powder coating facility with a coating booth 10 inside which is a robotically operated powder spray applicator 12, for applying a coating to a component 14, which could, for example, be a body part of a vehicle. Powder is supplied to the applicator 12 from a powder unit 16 by means of a suction unit 18 through a conduit (not shown). Powder unit 16 and suction unit 18 are adapted as a colour change system, which will be described in more detail below with reference to FIGS. 2 to 4. As shown in FIG. 1, a controller 20 controls operation of the powder coating facility.

Figure 2:
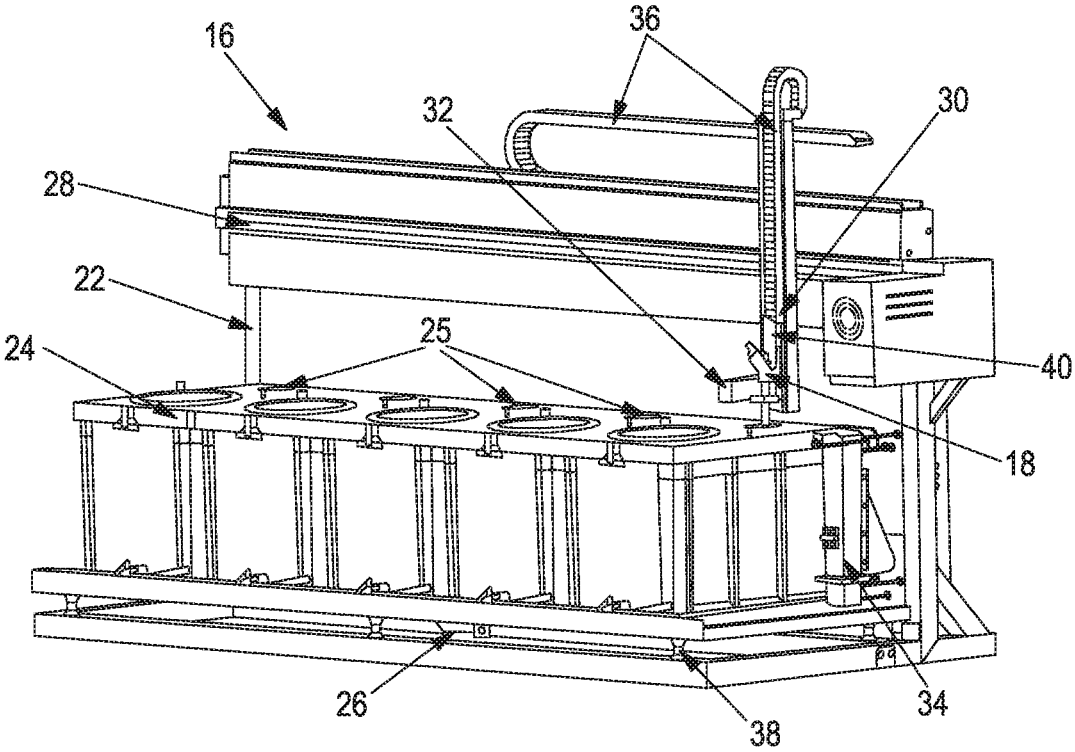
FIG. 2 shows more detail of the colour change system of the powder coating facility of FIG. 1.

FIG. 2 shows the powder unit 16 and suction unit 18 forming a colour change system embodiment. A frame 22 supports a number of powder containers 24 in the form of a line of boxes filled with powder, each container 24 containing a different colour of powder (five such containers are shown in FIG. 2, but it will be appreciated that any number of such containers may be employed, depending on the number of different colours to be sprayed). The frame 22 is in the form of a steel structure, with the containers 24 mounted on a plate with vibration dampers 38. A vibrator motor 26 is used to oscillate the boxes to prevent the powder compacting. A separate air supply may be provided to the containers 24 to fluidize the powder in the container that is supplying powder to the applicator 12. Such containers may be referred to as fluid boxes, as distinct from standard boxes, which are not provided with separate fluidization. Each of the containers 24 has one or more openings 25 for receiving an inlet end of the suction unit 18. The suction unit 18 connects to a powder delivery conduit 40. Examples of the suction units are described in more detail below with reference to FIGS. 5*a*, 5*b* and 6.

The suction unit 18 is mounted to a translation mechanism. As shown, the suction unit 18 is attached to a vertical, or Y-Axis linear translator 30 for moving the suction unit 18 up and down in the vertical direction. The suction unit 18 is attached to the conduit 40, which moves up and down with the suction unit 18. The inlet end (not shown) of the suction unit 18 can be moved in and out of the containers 24 through the openings 25. The suction unit 18 has an opening in its end into which powder can be drawn when it is lowered into a container 24. The conduit 40 extends from the powder unit 16 to the spray applicator 12 in the coating booth 10 by way of flexible hoses (not shown). The Y-axis translator 30, including the attached suction unit 18 and conduit 40 can be moved horizontally using a horizontal or X-axis translator 28. The X-axis translator 28 moves the suction unit 18 horizontally along the line of the containers 24. As shown herein, a third, or Z-axis translator 32 is attached to the Y-axis translator 30 and moves the suction unit 18 in a third direction, out of alignment with the openings 25 on the containers 24.

The Y-axis translator 30 may include a pneumatically operated cylinder for effecting the linear movement in the up and down directions. Alternatively the Y-axis translator may comprise any other suitable type of controllable linear actuator. Similarly, the Z-axis translator 32 may comprise a linear actuator such as a pneumatic cylinder, although it will be appreciated that to move the end of the suction unit 18 as described could be performed with other types of actuators, such as a rotary actuator. The X-axis translator 28 could also employ a pneumatic cylinder for providing linear movement. However, it will be appreciated that the distance of movement required for the X-axis actuator could be much larger, especially if a large number of different colours and associated containers 24 are provided. In that case the X-axis translator could employ a motor driven mechanism, such as a belt or chain.

Also shown in FIG. 2 is a cleaning unit 34 that provides for cleaning of the suction unit 18 and conduit 40 between colour changes. The cleaning unit may also be used to clean the paint passages of the one or more applicator guns. More details of the cleaning unit and its operation are described below with reference to FIGS. 4*a* and 4*b*.

Figure 3:
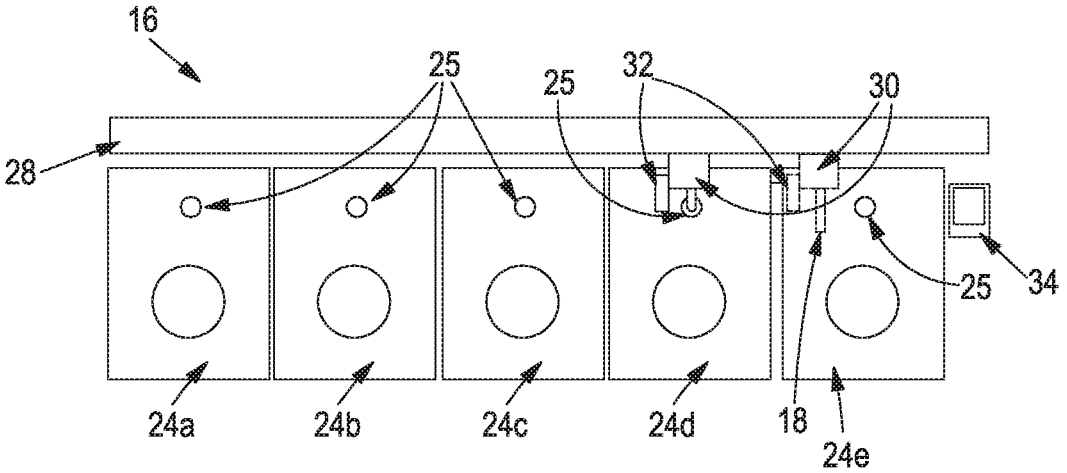
FIG. 3 is a plan view of the colour change system of FIG. 2.

FIG. 3 is a plan view showing the principal components of the powder unit 16, and where equivalent components have the same reference numerals as shown in FIG. 2. In FIG. 3 each of the containers 24 has been assigned a unique reference number—24*a* to 24*e*. As shown in FIG. 3 the suction unit 18, Y-axis translator 30 and Z-axis translator 32 are shown in two different X-axis positions, one position is shown with solid lines and the other with broken lines. In the position with solid lines, the Y-axis translator is positioned with the suction unit directly in line with an opening 25 on the top of the container 24*d*. In this position the end of the suction unit has entered the opening 25 by being vertically lowered into the container 24 by the Y-axis translator. In the broken line position the Y-axis translator is positioned in between openings 25 on containers 24*d* and 24*e*. In this position the Z-axis translator has moved the end of the suction unit 18 so that it extends beyond the openings 25 in the tops of the containers 24.

Figure 4A:
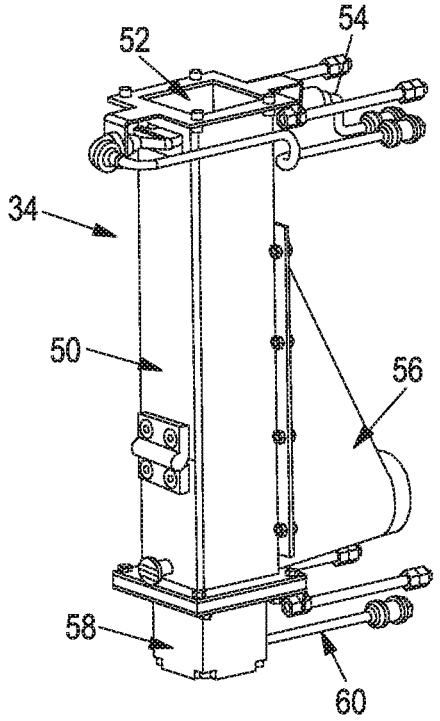
FIG. 4*a* depicts a cleaning unit forming part of the colour change system of FIG. 2.
Figure 4B:
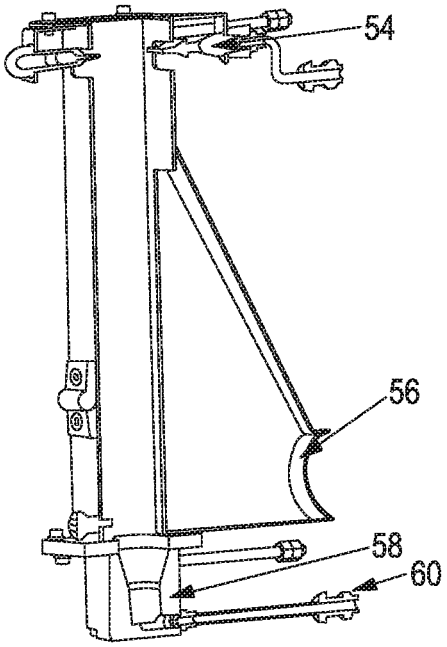
FIG. 4*b* shows a sectioned view of the cleaning unit of FIG. 4*a*.

FIGS. 4*a* and 4*b* depict the cleaning unit 34, which includes a vertical duct 50 with an open top 52. The open top 52 may be provided with a gasket. The gasket is configured to contain overspray of powder that may otherwise occur due to the application of air. A first compressed air inlet 54 is provided close to the top 52. An extraction duct 56 is attached along a lower part of one side of the duct 50 for connection to a suction device and filter (not shown). A conduit receiving piece 58 is attached to the bottom end of the duct 50 and is shaped to receive the end of the conduit 40 described above with reference to FIGS. 2 and 3. The conduit receiving piece 58 is connected to second compressed air inlet 60.

Figure 5A:
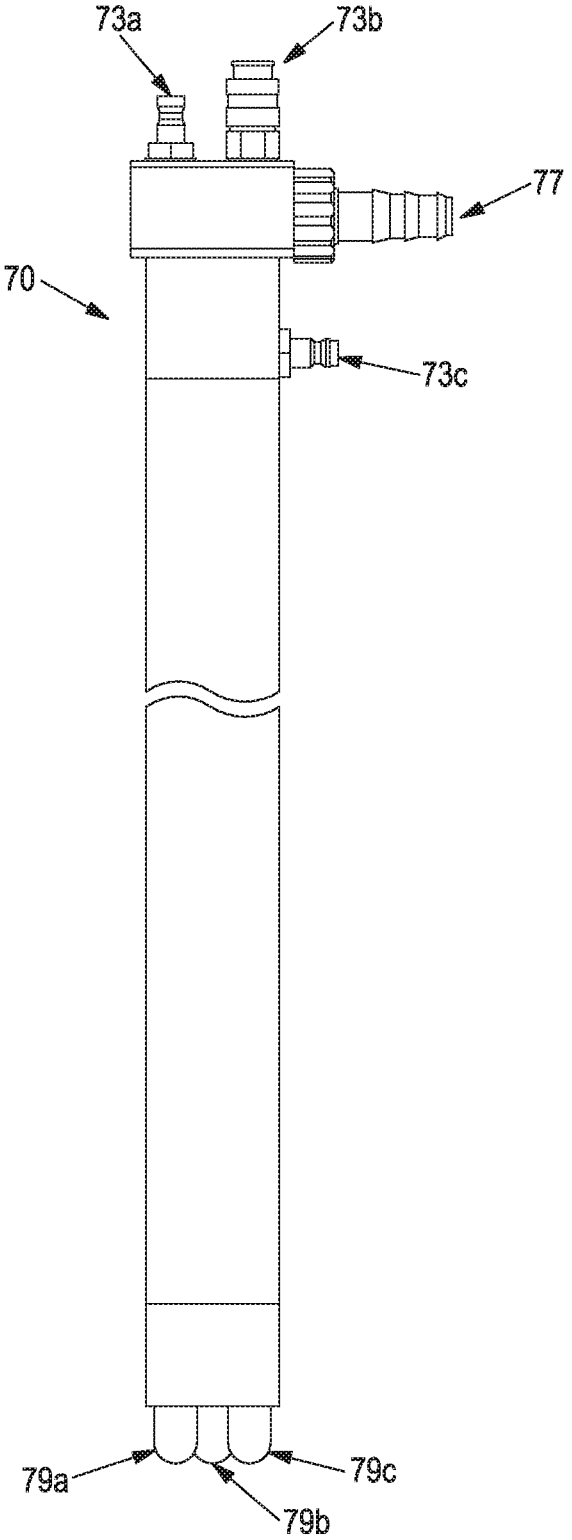
FIGS. 5*a* and 5*b* show elevation and cross-sectional views of a conventional powder suction unit.
Figure 5B:
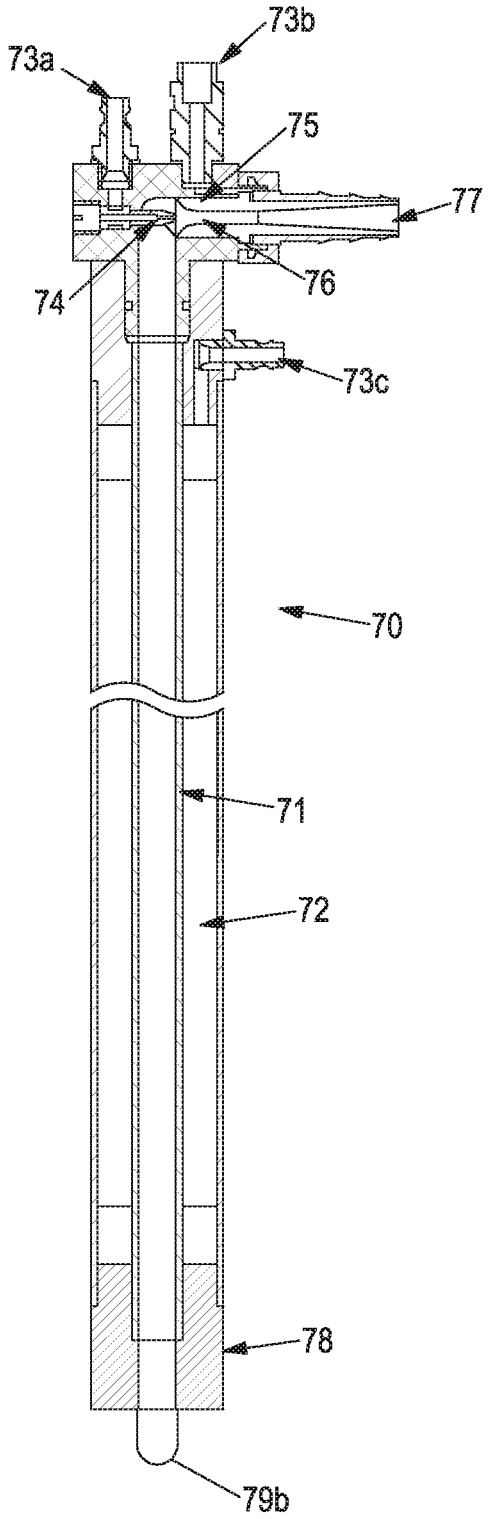

FIGS. 5*a* and 5*b* show a conventional suction unit 70, which is used in a generally vertical orientation as shown, and lowered into a container of coating powder. The suction unit 70 includes a central vertical tube 71, which is surrounded by an annular air passage 72. Air from a compressed air source is supplied to three connections 73*a*, 73*b* and 73*c*. The air supplied to connection 73*a* is fed to a nozzle 74 of an inducer 75. The air supplied to the nozzle 74 enters the throat of a venturi section 76 and this creates a suction in the central vertical tube 71 to draw powder up the tube. The venturi section 76 has an outlet end 77 which feeds into a conduit (not shown) along which the powder is to be conveyed. Air supplied to the connection 73*b* is also fed into the conduit as an additional flow for conveying the powder. Air supplied to the third connection 73*c* passes down the annular passage 72 to an end plug 78 where the air exits. This air fluidizes the surrounding powder in the container into which the suction unit 70 has been lowered. The end plug 78 surrounds inlets 79*a*, 79*b*, 79*c* distributed around the bottom end of the suction unit 70 and through which the powder is drawn up into the central tube 71.

The conventional suction unit 70 could be used in conjunction with the colour change system described above with reference to FIGS. 1 to 5. However, there are certain drawbacks with this design of suction unit. Firstly, the inducer 75 has to provide enough suction to lift powder up the entire height of the unit, which requires a large amount of energy in the compressed air leading to poor efficiency. Also, the suction unit 70 employs additional fluidisation air to assist the drawing in of powder around the inlets 79*a/b/c* because the amount of suction at the inlets 79*a/b/c* is limited by the capacity of the inducer.

Figure 6:
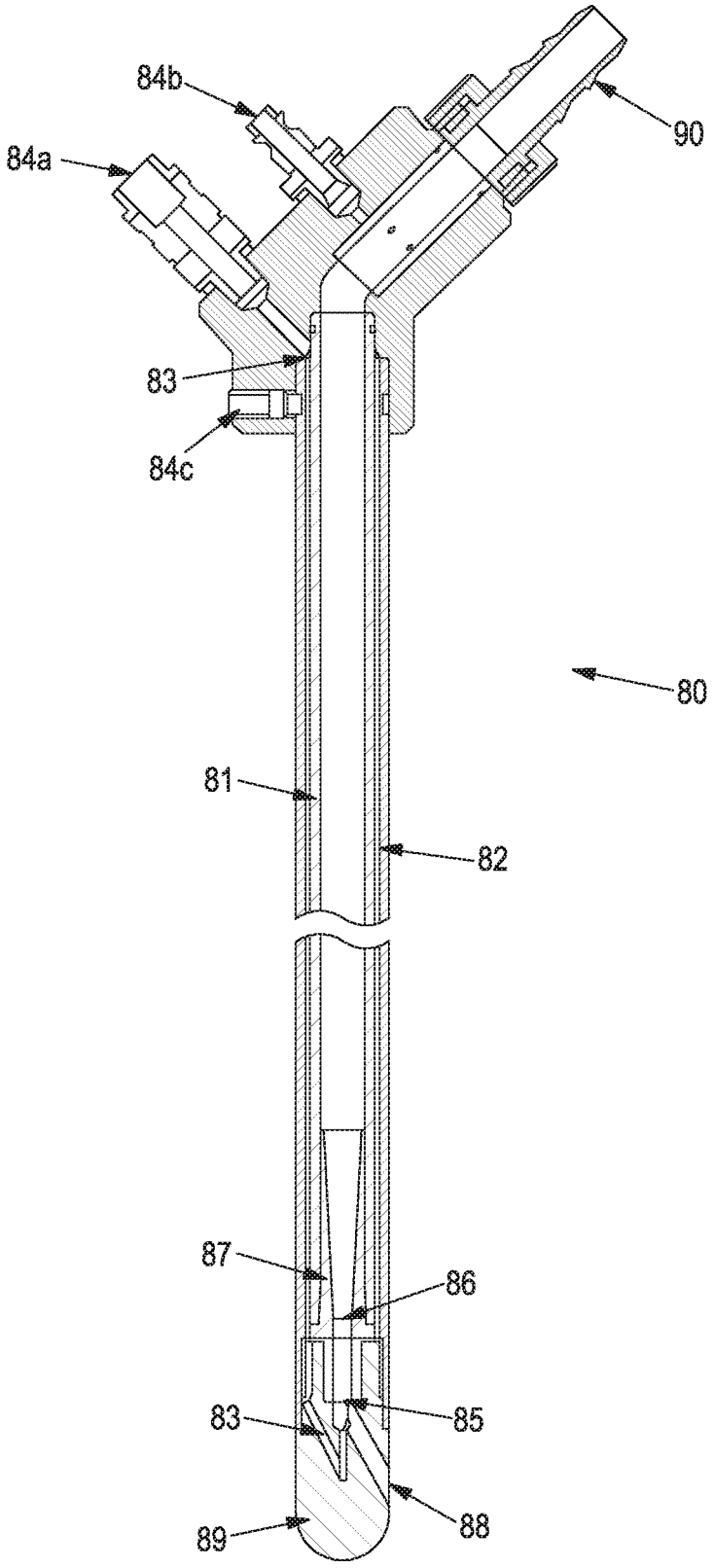
FIG. 6 is a cross-sectional view of a an improved powder suction unit more suitable for use with embodiments of the powder colour change system of the invention.

FIG. 6 shows a cross-sectional elevation of an improved suction unit 80, which is particularly suitable for use with the colour change system described above with reference to FIGS. 1 to 5. The suction unit 80 includes a central vertical tube 81, which is surrounded by a narrow air passage 82 and a further air duct 83. Air from a compressed air source is supplied to two connections 84*a* and 84*b*. The air supplied to connection 84*a* is fed via the air duct 83 to a nozzle 85 of an inducer 86, which is located close to the bottom end of the suction unit 80. The air supplied to the nozzle 85 enters the throat of a venturi section 87. The inducer 86 creates a suction, for drawing powder into the venturi section and blowing it on up the central tube 81. The powder is drawn in through openings 88 formed around a bottom section 89 of the suction unit 80. Powder drawn into the suction unit 80 is blown up the central tube 81 to an outlet end 90 which feeds into a conduit (not shown) along which the powder is to be conveyed. Air supplied to the connection 84*b* is also fed into the conduit as an additional flow for conveying the powder. Also shown in FIG. 6 is a screw 84*c* that is provided to hold the central vertical tube 81 in place.

Figure 7A:
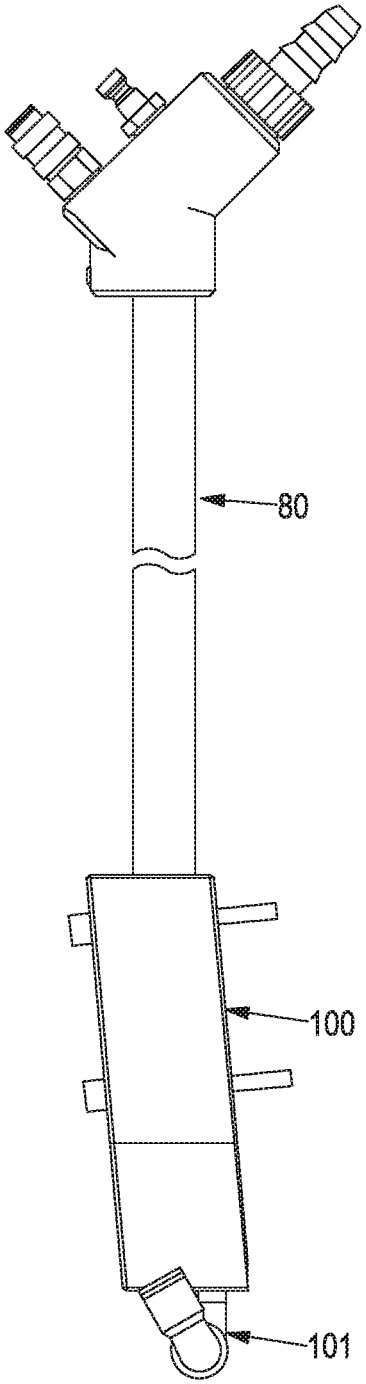
FIGS. 7*a* and 7*b* show elevation and cross-sectional views of the powder suction unit of FIG. 6 and a receiving piece of a cleaning unit.
Figure 7B:
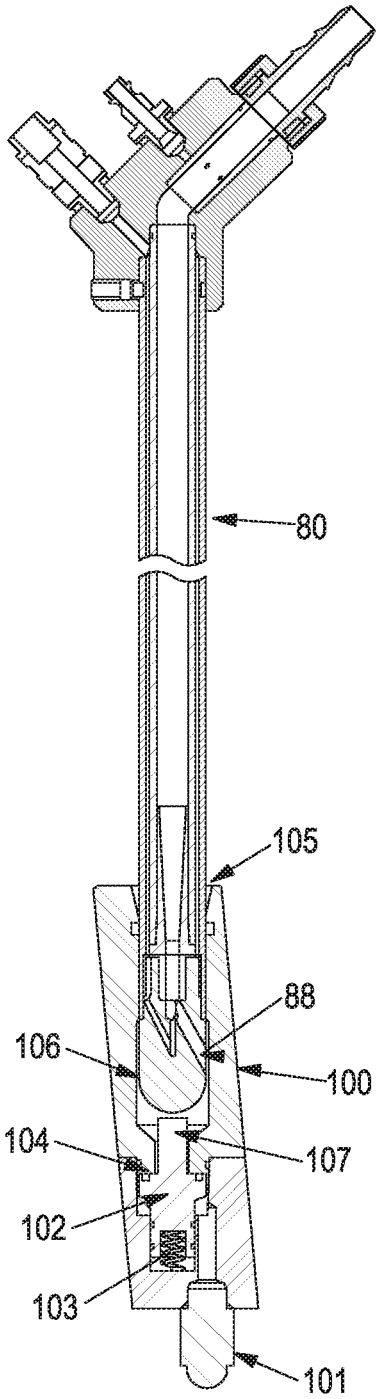

FIGS. 7*a* and 7*b* show elevation and cross-sectional views of the powder suction unit 80 of FIG. 6 and a receiving piece 100 of a cleaning unit, such as the receiving piece 58 of the cleaning unit 34 of FIGS. 4*a* and 4*b*. The receiving piece 100 includes a connection 101 for a cleaning fluid such as compressed air and an internal valve member 102. The valve member 102 is biased by a spring 103 so as to urge the valve member 102 into a closed position by virtue of a valve seat 104. The receiving piece 100 also includes a top opening 105 into a bore 106 for receiving the bottom end of the suction unit 80. The valve member 102 has an end 107 that extends upwardly into the bore 106 when the valve member 102 is in the closed position. When the suction unit 80 is inserted into the bore 106 through the opening 105 (e.g. by being lowered into the cleaning unit by the translation mechanism of the colour change system as described above), the bottom end of the suction unit 80 contacts the end 107 of the valve member 102 and pushes it down against the action of the spring 103 to open the valve and allow the cleaning fluid to be blown through the valve and into the suction unit 80 through the openings 88. In this way the inner surfaces of the suction unit 80 and ducting leading on to a powder spray applicator can be cleaned.

In use, when the powder coating applicator 12 (see FIG. 1) is applying a colour of coating, the bottom end of the conduit 40 is lowered into the correct colour container 24, such as container 24*d* as shown in the solid line position of the conduit 40, Y-axis translator 30 and Z-axis translator 32 in FIG. 3. The containers 24 are vibrated by the vibrator 26. In addition, embodiments may provide that air is supplied to the container 24*d* to fluidize the powder therein. The suction unit 18 (see FIG. 2) draws powder into the conduit 40, through its open end and this is conveyed along the conduit 40 to the applicator 12.

When it is required to change the colour of the coating at the applicator 12, the suction unit 18, vibrator 26 and fluidization air supplied to the container 24*d* are switched off. The Y-axis translator 30 is activated to raise the conduit 40 out of the container 24*d*. The Z-axis translator is activated to move the end of the conduit 40 out of alignment with the openings 25 in the tops of the containers 24. The X-axis translator then moves the conduit 40, together with Y-axis translator 30 and Z-axis translator 32, along to the cleaning unit 34. Note that during this movement the end of the conduit is moved across and above the container 24*e*, but because the end of the conduit 40 has been moved by the Z-axis translator it is not above the openings 25 and any powder that drops off or out of the conduit 40 will not fall into the different colour container 24*e* through its opening 25.

When the conduit 40 has been moved to the cleaning unit 34, the Y-axis translator lowers the conduit into the cleaning unit 34 through the open top 52, and down until the end of the conduit 40 is positioned in the receiving piece 58. Suction is provided to the extraction duct 56 and compressed air provided to the first compressed air inlet 54 for cleaning the outer surfaces of the conduit 40. This air is drawn down and out through the extraction duct 56. Compressed air is also provided to the second compressed air inlet 60 into the conduit receiving piece 58, which is shaped to direct the compressed air into the inside of the conduit 40. This air is blown along the entire length of the conduit 40 and out through the applicator 12, cleaning both the inside surfaces of the conduit 40 and the applicator 12.

Once cleaning has been completed, the air supplied to the first and second compressed air inlets is switched off, the Y-axis translator raises the conduit 40 out of the cleaning unit 34, the Z-axis translator moves the end of the conduit out of alignment with the openings 25 and the X-axis translator moves the conduit (with the Y-axis translator, and Z-axis translator) to the position of the container 24 of the next colour to be used (for example container 24*b*). During this movement the end of the conduit is moved across and above the containers 24*e*, 24*d* and 22*c*, but because the end of the conduit 40 has been moved by the Z-axis translator it is not above the openings 25 and any powder that drops off or out of the conduit 40 will not fall into the different colour containers through their openings 25. The Z-axis translator then moves the conduit 40 so that the end is directly above the opening 25 on the container 24*b* and the Y-axis translator lowers the conduit 40 into the container 24 through the opening 25. The vibrator 26 then restarts to vibrate the containers 24 and fluidising air is provided to the container 24*b*. Spray coating of the powder can then commence by activating the suction unit 18 to deliver powder to the applicator 12.

The examples above describe a system and method with a single end piece to be inserted into an opening of a powder container. It will be appreciated that the system may comprise any number of suction units, e.g. one, two or more suction units. For instance, a multiple gun system may comprise two or more suction units. Each powder container of a selected colour may comprise a corresponding number of openings, to allow each suction unit of a multiple gun system to be refilled at the same time.

The invention claimed is:

1. A colour change system for a powder coating facility, comprising:

a plurality of powder containers, each powder container holding one of a plurality of different coloured coating powders;

a conduit for conveying coating powder from one of the powder containers to a coating applicator;

a suction unit connected to the conduit and having an end-piece with an inlet opening into which coating powder is drawn, wherein the suction unit comprises an inducer in the end-piece adjacent to the inlet opening of the suction unit, and wherein the inducer comprises an air nozzle and a venturi tube section;

a cleaning unit;

a translation mechanism for moving the end-piece of the suction unit; and a controller, wherein:

each of the plurality of powder containers has an opening in an upper surface into which the end-piece of the suction unit can be inserted;

the cleaning unit comprises a top opening for receiving the end-piece of the suction unit, a vertically-oriented chamber for receiving the end-piece of the suction unit through the top opening, a first air blowing arrangement for cleaning an outer surface of the conduit within the vertically-oriented chamber, and a second air blowing arrangement for cleaning insides of the suction unit and the conduit within the vertically-oriented chamber; and the controller is configured to effect a change of coating powder colour by controlling the translation mechanism to extract the end-piece of the suction unit from a first powder container, to move the end-piece of the suction unit to the cleaning unit, and after cleaning to move the end-piece to a second, different powder container and insert the end-piece into the second, different powder container.

2. The colour change system of claim 1, wherein the translation mechanism comprises mechanisms providing a vertical or y-direction translation of the end-piece, a first horizontal or x-direction translation of the end-piece, and a third or z-direction translation of the end-piece, wherein movement in the third direction moves the end-piece out of alignment with the openings in the upper surfaces of the powder containers.

3. The colour change system of claim 2, wherein movement in each of the y-direction, x-direction and z-direction is independently controllable by the controller.

4. The colour change system of claim 1, wherein the translation mechanism comprises at least one pneumatically operated cylinder.

5. The colour change system of claim 1, wherein the first air blowing arrangement comprises one or more nozzles through which air is blown into the vertically-oriented chamber and over the outer surface of the conduit, and an air outlet for removing air and powder removed off the outer surface of the conduit from the vertically-oriented chamber.

6. The colour change system of claim 5, wherein the one or more nozzles are located adjacent the top opening and the air outlet is located adjacent a bottom of the vertically-oriented chamber.

7. The colour change system of claim 5, wherein the air outlet is configured to couple to a suction device configured to provide suction to draw air and powder out of the air outlet.

8. The colour change system of claim 1, wherein the second air blowing arrangement comprises an air inlet for blowing air into the inlet opening of the suction unit.

9. The colour change system of claim 8, wherein the second air blowing arrangement comprises a spring valve that is configured to be activated by contact from the end-piece of the suction unit to open and permit air to be blown into the inlet opening of the suction unit.

10. The colour change system of claim 1, wherein the inducer is located at one end of a tube that connects to the conduit and the suction unit further comprises a passage for compressed air to be provided to the air nozzle.

11. The colour change system of claim 1, wherein the inlet opening of the suction unit comprises a plurality of inlet channels leading from an exterior of the end-piece to the inducer.

12. The colour change system of claim 1, wherein the suction unit further comprises an air duct for providing air to fluidise powder in the vicinity of the inlet opening.

13. A method of changing colour in a powder coating facility, the method comprising:

providing a colour changing apparatus comprising:

a plurality of powder containers, each powder container holding one of a plurality of different coloured coating powders;

a conduit for conveying coating powder from one of the powder containers to a coating applicator;

a suction unit connected to the conduit and having an end-piece with an inlet opening into which coating powder is drawn, wherein the suction unit comprises an inducer in the end-piece adjacent to the inlet opening of the end-piece, and wherein the inducer comprises an air nozzle and a venturi tube section;

a cleaning unit comprising a vertically-oriented chamber for receiving the conduit and the end-piece of the suction unit, a first air blowing arrangement for cleaning an outer surface of the conduit within the vertically-oriented chamber, and a second air blowing arrangement for cleaning insides of the suction unit and the conduit within the vertically-oriented chamber; and a translation mechanism for moving the end-piece of the suction unit;

extracting the end-piece of the suction unit from a first powder container;

moving the suction unit to the cleaning unit and inserting the conduit and the suction unit into the vertically-oriented chamber of the cleaning unit;

cleaning the suction unit and the conduit within the vertically-oriented chamber with air discharged from the first air blowing arrangement and the second air blowing arrangement;

providing suction to the vertically-oriented chamber of the cleaning unit to draw air out of the vertically-oriented chamber of the cleaning unit after cleaning, moving the suction unit to a second, different powder container; and inserting the end-piece of the suction unit into the second, different powder container.

* * * * *